United States Patent [19]

Jansen

[11] 3,999,344

[45] Dec. 28, 1976

[54] BUILDING CONSTRUCTION AND WALL PANEL FOR SUCH CONSTRUCTION

[76] Inventor: Wilhelmus Theodorus Maria Jansen, Rozebotteltuin 7, Schalkhaar, Netherlands

[22] Filed: Aug. 4, 1975

[21] Appl. No.: 601,415

[30] Foreign Application Priority Data

Aug. 12, 1974 Netherlands ..... 7410790

[52] U.S. Cl. ..... 52/265; 52/270; 52/288; 52/309.1; 52/403; 52/592

[51] Int. Cl.[2] ..... E04B 1/66; E04B 5/00

[58] Field of Search ..... 52/264, 265, 309, 392, 52/521, 556, 592, 595, 188, 403

[56] References Cited

UNITED STATES PATENTS

| | | | |
|---|---|---|---|
| 1,766,125 | 6/1930 | Jahns | 52/264 X |
| 2,717,668 | 9/1955 | Johnson et al. | 52/556 X |
| 3,182,767 | 5/1965 | Kuehl | 52/265 X |
| 3,420,024 | 1/1969 | Salvo | 52/521 X |
| 3,745,733 | 7/1973 | Lilvin | 52/264 X |
| 3,777,430 | 12/1973 | Tischuk | 52/595 X |
| 3,875,715 | 4/1975 | Martin et al. | 52/556 |

FOREIGN PATENTS OR APPLICATIONS

| | | | |
|---|---|---|---|
| 486,348 | 9/1952 | Canada | 52/592 |

*Primary Examiner*—Alfred C. Perham
*Attorney, Agent, or Firm*—Kurt Kelman

[57] ABSTRACT

The invention provides an easy to assemble stabile building construction having wall portions provided with a sheet of synthetic material, which at the edges of the wall portions is inturned to form a ledge or a groove, the thickness of the sheet being considerably smaller than that of the wall portions.

18 Claims, 4 Drawing Figures

BUILDING CONSTRUCTION AND WALL PANEL FOR SUCH CONSTRUCTION

The invention relates to a building construction, which can be composed of prefabricated portions. More in particular, but not exclusively, the invention aims at providing a building construction, which is suitable for bathrooms, shower cubicles, lavatories, combined so-called wet cells, and so on. To such constructions the requirement is made, that they can easily be made well waterproof, have a surface that is water resistant and can be cleaned well.

An additional requirement, which often is made, to such a building construction, is that it can be built-in. This in particular, but not exclusively, is the case when providing a bathroom or shower cubicle in existing houses. With such a built-in the difficulty can occur, that it is not possible to pre-assemble the cell and then to place it, for the simple reason, that it is too big for the entrance to the space in which it has to be provided. A further difficulty can be, that, when placing the cell, it is not accessible from the outside.

The invention aims at providing a building construction, with which the above-mentioned difficulties can in principle be removed. For this purpose it is provided according to the invention, that the wall portions on one side have a sheet of synthetic material, the thickness of which is considerably smaller than the construction thickness of the wall portion, said sheet of synthetic material being inturned at the edge of the wall portion, such that said inturned portion forms at least one limiting surface of a groove or a ledge.

When applying the invention it is namely possible to build up the cell in an enclosed space almost without any play and still to obtain a sufficient rigidity, because the grooves and the ledges are relatively large and by this are stable, with which the manufacturing costs can be low, because in comparison with the constructional thickness of the wall portions relatively little synthetic material is used. In general, but not exclusively, the synthetic material is reinforced synthetic material, e.g. polyester reinforced with glass fibres.

Preferably the grooves are obtained by a Z-shaped curvature of the edge of the sheet of synthetic material while a ledge can be formed by an obtuse angle and a stiffening member, which is provided along the edge of the relating wall portion.

Preferably the groove is limited by two planes including an acute angle with each other, said angle being preferably between 30° and 60° and even more preferred between 40° and 50°. In practice very good results with respect to the stability and assembling ease have been obtained with an angle of 45°.

When applying the invention the wall portions need not be flat. It can even be advantageous to use curved or angled wall portions. When such a wall portion e.g. is oriented vertically and at its lower and upper sides is retained by a groove and ledge joint, a very stable complete construction originates.

When building up a building construction according to the invention one can e.g. start from a bottom construction having a raised continuous ledge being mounted in a horizontal plane with e.g. a gap near the door of the construction to be made.

When mounting the construction according to the invention it is advantageous when perpendicular wall portions and angle portions, which interlock by means of a ledge and a groove are provided with a ledge or a groove on their vertical side edges in such a way, that, seen in a horizontal plane and from the interior of the construction always on the same side a groove and on the other side a ledge is provided. Said wall portions then can be mounted very easily and be locked by a doorcase.

The invention also relates to a wall portion, adapted to be applied to the above described building construction.

In the following the invention is further elucidated with reference to the accompanying drawings, in which.

Figure 1:
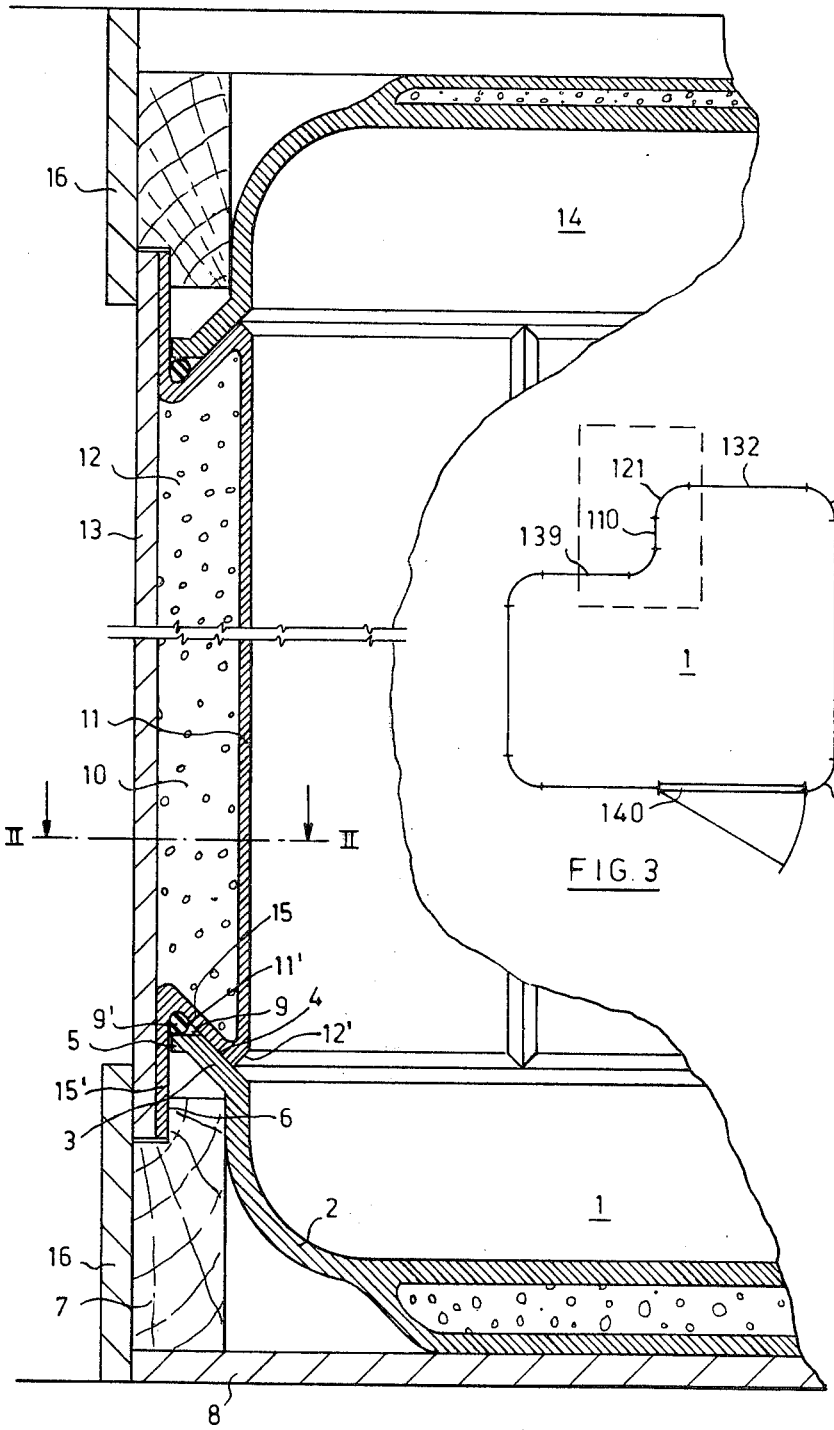
FIG. 1 shows a vertical section through part of a construction according to the invention.

In FIG. 1 a bottom is indicated by 1, said bottom consisting of a shallow reservoir 2 of laminated synthetic material with at the edge a ledge 3, which on the one side is limited by a bevelled side plane 4 of the edge of the reservoir 2 and on the other side by the end rim 5 and a plane 6 of a beam 7, which is fixedly connected with the reservoir 2 and a base plate 8. Plane 4 and the vertical plane contiguous to 5 and 6 include an angle of about 45°. At the end of plane 4 a horizontal flange is made, by which a space 9 originates, in which a sealing cord 9' is present. On the ledge formed by planes 4, 5 and 6 a groove is placed of a panel 10. Said panel comprises a sheet 11 of synthetic material, which at 12' is tapered, is inturned at 11' with a portion 15 and again turned back to form a vertical flange 15'. Planes 4, 5 and 6 fit into the groove formed by the surfaces of 15 and 15'.

Panel 10 furthermore has a filling 12 and an end plate 13, e.g. of chipboard. It is further possible to provide a wooden framework along the edge of the space which is filled by mass 12 (not shown).

Ceiling 14 substantially is of the same construction as the bottom reservoir 1. For this reason a further description is considered to be superfluous. It will be clear, that, when the stability of the whole construction makes it necessary, ceiling 14 can either be weight-loaded or be biased downwardly with regard to an other construction, e.g. a building into which the construction according to the invention is built in. e.g. by means of wedges (not shown).

Finally FIG. 1 shows timberlines 16. The latter are not essential for the construction itself and serve as a finish. In this connection it is pointed out, that the invention can have a well-finished wall at the outside, should this be desired, but that in many instances a simple rough finish is sufficient, e.g. when the construction is built in an existing building.

Figure 2:
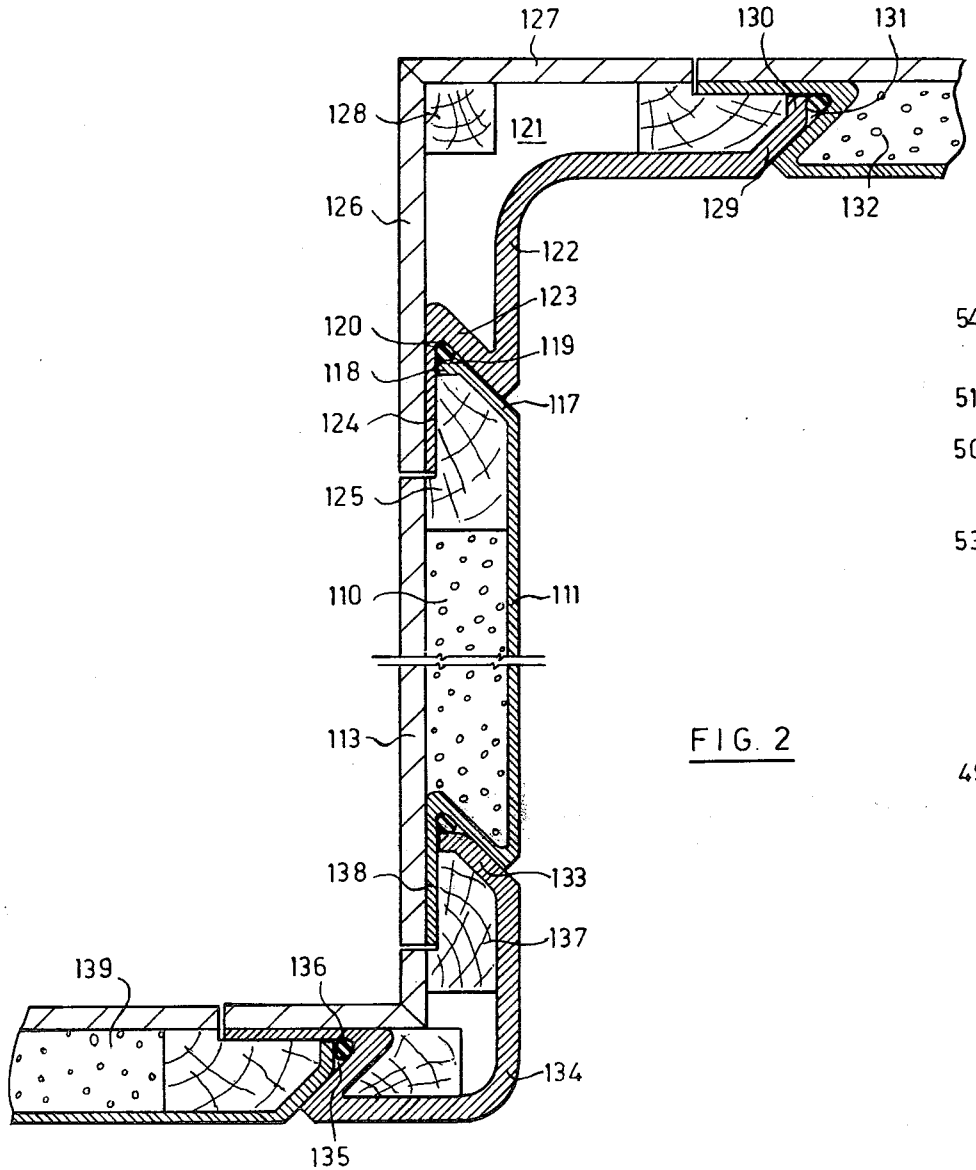
FIG. 2 shows a horizontal section along the line II—II of FIG. 1.

As appears more in particular from FIG. 2 panel 110 is on one side provided with a protruding edge 117, which again consists of an inturned portion including an angle of about 135° with the sheet 111 of laminated synthetic material. The inturned portion 117 passes into a horizontal flange 118, by which space 119 remains open, in which a sealing cord 120 is provided. Panel 110 co-operates with a corner portion 121, which has internally a sheet of laminated synthetic material 122, which is curved over 90° and near its one end via portions 123 and 124 is Z-shaped. The inner plane of portion 124 is contiguous to beam 125 of panel 110, while portion 123 with its lower plane is contiguous to portion 117 of panel 110. For the rest the co-operation of this construction, but now in a vertical plane, is completely analogous to what holds for the connection between portions 1 and 10 and 10 and 14 respectively of FIG. 1. The corner portion 121 is externally provided with covering plates 126 and 127 and a corner post 128. Said portions can serve either to attach the complete construction to an already existing construction or to obtain a flat finish, but are not essential for the invention.

On the other side of the curved portion 122 again an inturned portion 129 is provided, terminating in a small flange portion 130. This co-operates with the groove 131, which in the earlier described way is formed by a further panel 132.

On the other side of the panel 110 this is in engagement with the protruding edge 133 of an inner corner portion 134, which on its other side after a 90°'s curvature ends into a groove 135, in which again a sealing cord 136 is provided. Beam 137 serves for the co-operation with plane 138 of the end edge of the sheet 111. This construction, too, is again completely analogous to what has been described earlier. In the same way a connection is formed with a further panel 139.

Figure 3:
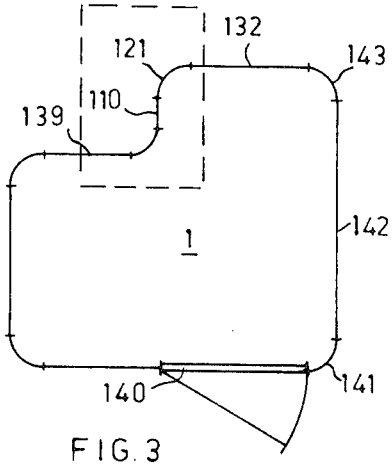
FIG. 3 shows schematically a top view of a construction according to the invention, in which in interrupted lines the part is indicated, which on an enlarged scale is indicated in FIG. 2.

When considering FIG. 2 it will be striking that, if one goes along the periphery, the ledges and the grooves have always been provided in the same direction. This gives a very easy assembly. To elucidate this it is referred to FIG. 3 where first e.g. adjacent to a doorcase 140 a corner portion 141 is provided. This takes place by causing said corner portion, which at its lower side has a groove, to sink onto the portion of the ledge of the bottom portion 1 belonging thereto. For this only a play equalling the depth of the groove is necessary. Thereupon panel 142 is put on the ledge of the bottom portion 1 and shifted against the corner portion 141, after a sealing cord has been provided between the portions 141 and 142. Corner portion 143 then can be brought with its protruding edge into the groove of portion 142 and be let down somewhat so that it comes to rest on the ledge of the bottom portion 1 belonging thereto. In this way one can work on until one again meets the doorcase 140.

The attachment of the doorcase 140 to the panels can be of any suitable construction, which in any known way are mounted to the panels. When use is made of a standard doorcase it can be desired therewith to saw off a side edge of a panel or a corner portion square-headedly. Another possibility is, however, that use is made of doorcases, having a shape corresponding to those of the protruding edges and grooves of the panels according to the invention, with which, it is very simple then to mount the vertical posts of the door panel and to bring them by means of a threshold and an upper beam into a fixed permanent cooperation with the panels belonging thereto. If the wall portion should be connected to an outer construction, it is possible to nail through the flanges such as 124 and 138. This gives the advantage that the nails cannot give rise to leakage (because they are located behind the sealing cords such as 119) and that the heads of the nails are not visible.

The construction according to the invention as described up to now has the advantage, that sufficient strength is obtained even without making use of additional attachment means, both mutually for the parts of the construction itself and for attachment to other building construction parts. This gives the possibility of very quick working. Moreover by applying the invention a well-outlined complete construction is obtained, which easily, e.g. by means of the indicated elastic sealing cords can be made waterproof.

It will be clear that when no permanent bottom is used, the invention can be applied, too, when on a base a lath is provided corresponding to the ledge of the bottom portion 1. Thereon the panels can then be provided. With this embodiment one can both use preformed curved portions for this lath at the corners, should one want to have curved corners, or square-angled corner members.

Figure 4:
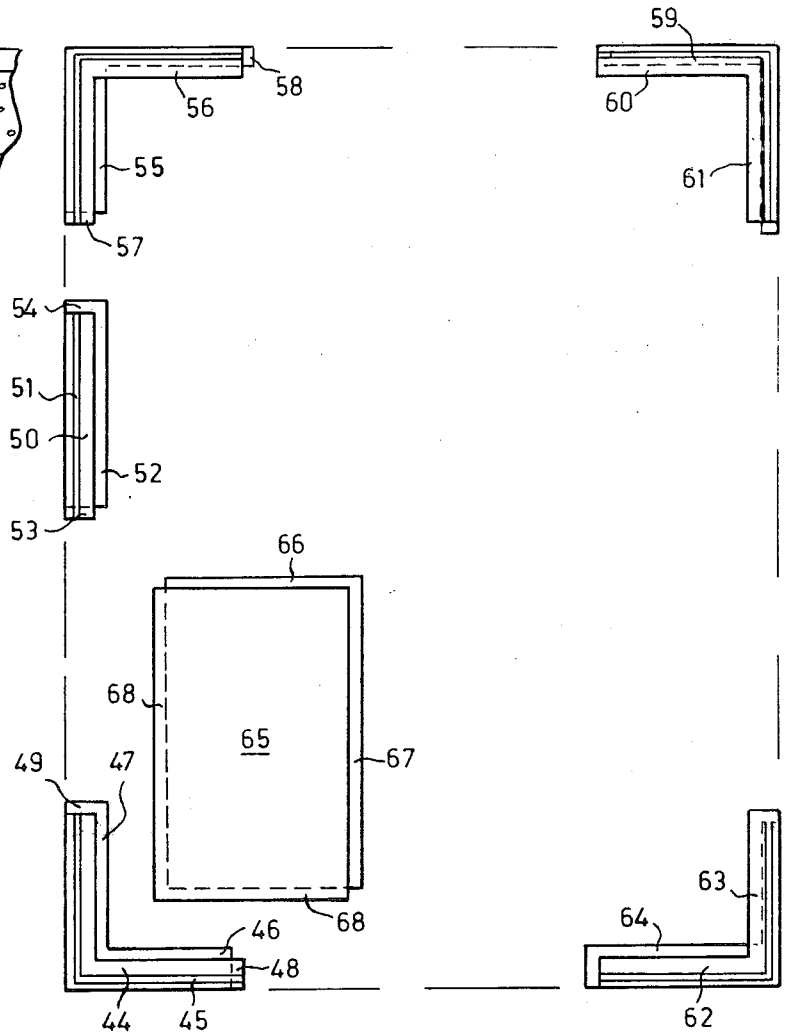
FIG. 4 schematically shows a bottom plane built up from edge members and panels.

It is also possible to execute both the sidewalls and the bottom portions in a number of panels. To elucidate this it is referred to FIG. 4. In this figure a corner member 44, with a ledge 45 thereon has been shown. To the inner plane of one leg of the corner member a protruding ledge 46 is provided and a corresponding ledge 47 is present on the inner plane of the other leg of the corner member. Said corner member 44 furthermore has at the end of its one leg a groove 48 and at the end of its other leg a ledge 49. To said corner portion one or more edge portions 50 can fit with a ledge 51 thereon, on the inner side a ledge 52, near an end plane a groove 53 and on the other end plane a ledge 54. The next corner portion on one inner side has a ledge 55 and on the inner side of the other leg a groove 56. The end planes again are provided with a groove 57 and a ledge 58 respectively. The next corner portion 59 on its inner side has a pair of grooves 60 and 61 and at its end plane again a groove and a ledge respectively. Finally corner portion 62 on the inner side of the one leg has a groove 63 and a ledge 64 on the inner side of the other leg. A panel 65 is on two adjacent sides provided with ledges 66 and 67 respectively and on its other sides with a groove 68. Now it is possible to make a bottom consisting of a number of panels, that all are identical. These panels are wall portions as earlier described, and other wall portions can be mounted on the vertical ledges such as 45 and 51.

If only a tiling has to be made without raised edges, the corner pieces such as 44 and edge portions such as 50 are replaced by simple laths, which co-operate with the ledges 67 or the grooves 68, in which case they are either provided with a groove or a ledge. In this way a reliable mounting can be obtained of a waterproof tiling, without a distinct skill being required for that.

In the shown embodiments the smooth walls are on the inside. It will be clear that the invention can also be applied when these walls are either on the outside or that both the in- and the outsides are smoothly finished.

When, as is known in itself, e.g. with a wet cell, certain construction parts such as a water-closet, washbowl or the like are mounted to the panels, the invention has the advantage, that, after this panel has been mounted the remaining walls are still free, which mostly facilitates the assembling work in an enclosed space.

When the construction according to the invention is used without a doorcase such as 140, the ultimate panel or corner portion has to be shifted in from the top downwards. This can cause difficulties when one builds in into existing buildings, so that the doorcase has the double task to make the building construction accessible and to facilitate the construction thereof considerably.

Although various embodiments of elements, useful when applying the invention, have been shown, it will be clear that also different combinations are possible. It is e.g. possible to combine a corner portion 44 with a panel portion 65. Edge portions such as 50 can also be directly connected with a panel portion. Further with very big constructions the ceiling can consist of a number of separate portions.

In order to make sure what is meant with the construction thickness of a wall portion or panel reference is made to the drawing.

Panel 10 in FIG. 1 has a construction thickness equalling the sum of the thicknesses of sheet 11 and the filling mass layer 12. This means that for a flat wall portion the construction thickness is well-defined as the height of the sheet with its edge when it is laid flat on a horizontal plane.

For a curved wall portion the construction thickness is that of its edge portion, e.g. for portion 121 (FIG. 2) the perpendicular distance of the inner surface of sheet 122 to the outer surface of flange 124.

With considerable smaller is meant smaller than half. In actual practice the sheet's thickness is mostly less than one fifth and often even than one tenth of the construction thickness.

In practice good results have been obtained with a construction thickness of 2–5 cms.

Though in the drawing always sealing cords have been shown, other sealing means, such as lute that also after hardening shows some elasticity have proven to be satisfactory.

I claim:

1. A building construction which comprises in combination, wall portions having edges provided with interfitting means, said interfitting means consisting of ledges and grooves, said ledges and grooves having at least one oblique surface, the oblique surfaces of the ledge engaging the oblique surfaces of the grooves, a floor track having at an upper side said interfitting means cooperating with interfitting means of vertical wall portions, at least some of the vertical wall portions having corner elements, co-adjacent vertical wall portions having said interfitting means, the wall portions having a sheet synthetic material which is curved at the edge to form at least part of an interfitting means, the thickness of the sheet being smaller than half of the constructions thickness of a wall element.

2. A building construction according to claim 1, characterized in that the sheet of synthetic material along the edge, where a groove is present, first is inturned at an acute angle and thereupon, also at an acute angle, is bent back, such that a Z-shaped curvature is obtained.

3. A building construction according to claim 1, characterized in that along the edges of the wall portions, where a ledge is present, the sheet of synthetic material is inturned at an obtuse angle.

4. A building construction according to claim 1, characterized in that between a groove and a ledge present therein an elastic sealing member is provided.

5. A building construction according to claim 1, characterized in that the groove on two sides is limited by the sheet of synthetic material and the ledge on at least one side is limited by said sheet, said sheet being bent back somewhat at the location of the highest rim of the ledge, by which a space originates for an elastic sealing member.

6. A building construction according to claim 1, characterized in that along at least one edge of a wall portion a stiffening element is provided, a part of which forms parts of a surface of a ledge or a groove.

7. A building construction according to claim 1, characterized in that a stiffening element is of wood.

8. A building construction according to claim 1, characterized in that the groove has two walls, including an acute angle.

9. A building construction according to claim 1, characterized in that the acute angle is between 30° and 60°, preferably between 40° and 50°.

10. A building construction according to claim 1, in which one of the walls of the groove is parallel to the sheet of synthetic material adjacent the inturned edge.

11. A building construction according to claim 1, with an integral bottom and rim which forms a floor track and sidewalls, and having members present along the rim of the bottom, said members having a ledge or a groove on a. the upper sides;
b. the sides turned towards the bottom, thus the inner side of the construction; and
c. the sides which are adjacent with which all edge portions on their upper sides have the same ledge and groove.

12. A building construction according to claim 1 with which each vertical wall portion, seen in the horizontal plane as from the interior of the construction, has a groove on the same side and a ledge on the other side.

13. A wall panel for application to a building construction according to claim 1 having a sheet of synthetic material, which at the edges is inclined to form interfitting means consisting of ledges and grooves, the inturning of the sheet to form a groove consisting of an acute angle, a plane oblique surface and a further acute angle equal to the first but the other side around, the inturning of the sheet to form a ledge consisting of an obtuse angle, the sum of the said acute and obtuse angles being 180° and the thickness of the sheet being less than half of the construction thickness of the wall panel.

14. A wall panel according to claim 13, characterized in that behind the sheet of synthetic material a supporting and filling layer is provided.

15. A wall panel according to claim 13, characterized in that a stiffening element is provided along at least one edge.

16. A wall panel according to claim 13, characterized in that the stiffening element forms a part of the limitation of a ledge.

17. A wall element according to claim 13, characterized in that on the backside a covering plate is provided.

18. A wall element according to claim 13, characterized in that it is curved, so that it can serve as corner element.

* * * * *